US006776302B2

(12) United States Patent
Morris, Sr.

(10) Patent No.: US 6,776,302 B2
(45) Date of Patent: Aug. 17, 2004

(54) OPEN ENDED CONTAINER WITH LOCKING LID ASSEMBLY

(75) Inventor: Glenn H. Morris, Sr., Elder Mountain, TN (US)

(73) Assignee: M & M Industries, Inc., Chattanooga, TN (US)

( * ) Notice: Subject to any disclaimer, the term of this patent is extended or adjusted under 35 U.S.C. 154(b) by 0 days.

(21) Appl. No.: 10/127,892

(22) Filed: Apr. 22, 2002

(65) Prior Publication Data

US 2004/0007576 A1 Jan. 15, 2004

(51) Int. Cl.[7] ..... B65D 41/04
(52) U.S. Cl. ..... 220/288; 220/324; 206/508
(58) Field of Search ..... 215/329, 330, 215/214, 216, 217; 220/324, 326, 288, 783, 797; 206/508

(56) References Cited

U.S. PATENT DOCUMENTS

| | | | | | |
|---|---|---|---|---|---|
| 4,288,000 | A | * | 9/1981 | Luker et al. | 220/281 |
| 4,453,647 | A | * | 6/1984 | Neat | 220/288 |
| 4,732,288 | A | * | 3/1988 | Morris, Sr. | 215/214 |
| 4,967,926 | A | * | 11/1990 | Morris, Sr. | 220/323 |
| 5,125,538 | A | * | 6/1992 | Morris, Sr. | 222/143 |
| 5,377,858 | A | * | 1/1995 | Morris, Sr. | 220/254.8 |
| 5,785,203 | A | * | 7/1998 | Arshinoff et al. | 220/783 |
| 5,915,575 | A | * | 6/1999 | Morris, Sr. | 215/214 |
| 5,944,214 | A | * | 8/1999 | Conti et al. | 220/304 |
| 6,006,942 | A | * | 12/1999 | Morris et al. | 220/288 |
| 6,032,817 | A | * | 3/2000 | Ejima et al. | 220/284 |
| 6,170,691 | B1 | * | 1/2001 | Morris et al. | 220/304 |

FOREIGN PATENT DOCUMENTS

EP 0 302 578 A2 * 2/1989

* cited by examiner

*Primary Examiner*—Robin A. Hylton
(74) *Attorney, Agent, or Firm*—Stephen J. Stark; Miller & Martin PLLC

(57) ABSTRACT

A container assembly has a lid which connects to an open ended container. The container has a wall which defines a cavity therein and has an outer surface with a plurality of outwardly directed teeth and at least outwardly directed thread. The teeth are located intermediate the threads and a top of the container wall. The lid has an outer wall with an inwardly directed blade on a leg which cooperates with the outwardly directed teeth on the exterior surface of the container. The lid also has a cutout in a ridge which allows at least a portion of a locking member to extend therethrough, the locking member is normally biased toward a center of the lid in a first position so that the leg is brought into contact with the teeth on the container. The locking member can be moved to a second position to disengage the leg from the teeth to allow rotation in at least one direction. Additionally, the teeth and leg may be configured to allow for the lid to be tightened relative to the container in the first position, but not loosened.

20 Claims, 3 Drawing Sheets

OPEN ENDED CONTAINER WITH LOCKING LID ASSEMBLY

BACKGROUND OF THE INVENTION

The present invention relates to a threaded closure assembly, and more particularly, to an open ended container having a lid provided with at least one resiliently biased locking member.

Many resources have been devoted to providing an improved locking lid which cooperates with an open end container. U.S. Pat. Nos. 4,732,288, 4,967,926, 5,125,858, 5,377,858, and 5,915,575 each show improvements to the container assemblies wherein the top, or lid, has a locking feature relative to the open end container.

While these locking lid assemblies have been satisfactory for their intended purposes, they all provide an open ended container with a plurality of inwardly directed teeth. In order for the locking mechanism to operate satisfactorily, space between the teeth and the lid is present in each of these designs. In order to prevent leaking through this space, various sealing techniques have been implemented including double walled containers as shown in U.S. Pat. Nos. 4,732,288 and 5,915,575 and as single slanted wall design as in U.S. Pat. No. 4,967,926 so that a seal may be formed interior to the space.

In spite of the improvements which have been developed with the inwardly directed teeth locking systems, a need still exists to develop an improved locking system.

SUMMARY OF THE INVENTION

Consequently, it is an object of the present invention to provide a locking lid assembly for use with open ended containers wherein the container has outwardly directed teeth instead of inwardly directed teeth.

It is a further object of the present invention to provide a simple, effective locking system for use with plastic pails and lids.

It is another object of the present invention to provide a relatively smooth interior surface of a container without the need for a separate second wall, such as a skirt, to provide a surface for mounting inwardly directed threads.

Accordingly, a container assembly has an open ended container with outwardly directed teeth proximate to the open end on an outer surface of the container. Threads are located on the outer surface of the container below the outwardly directed teeth. A lid with a biased locking mechanism has inwardly directed threads on a downwardly extending outer wall of the lid which cooperate with the outwardly directed threads on the outer surface of the container to allow the lid to be threaded onto the container.

The lid has a locking mechanism including an arm which is configured to engage the teeth. The arm extends downwardly through an opening in a ridge which connects the outer wall to a central disc member. The arm is biased towards the central disc member. As the lid is threaded onto the container, the arm of the locking mechanism contacts the teeth. The arm preferably includes a blade configured to cooperate with the teeth to allow the top to be tightened, but resist the loosening of the top without first disengaging the arm from the teeth.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
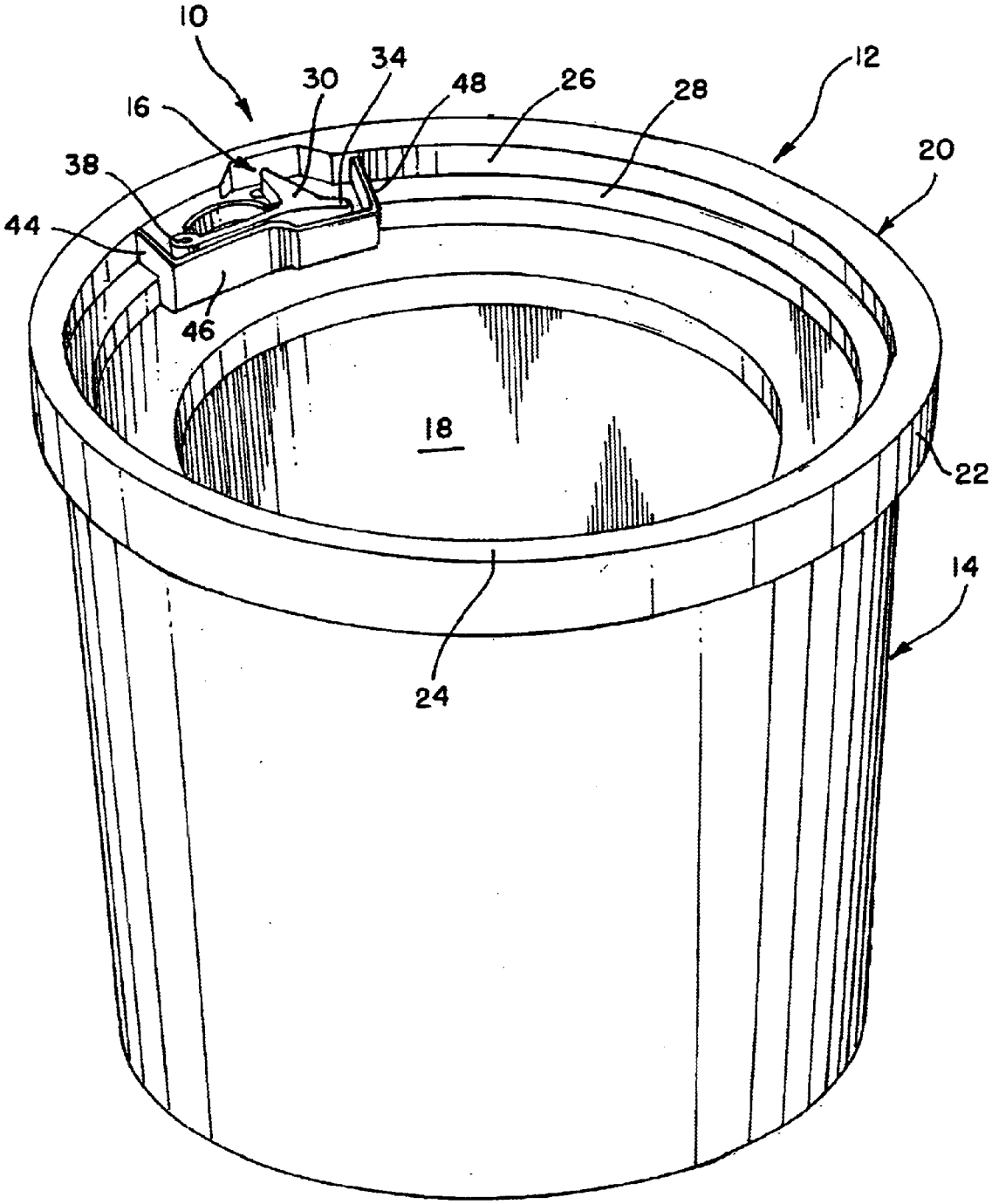
FIG. 1 is a top elevational view of an open ended container with a lid having a locking mechanism of the present invention.

FIG. 1 shows a container assembly 10 comprising a lid 12 and an open ended container 14. A locking mechanism 16 resists the removal of the lid 12 from the container 14 when the lid 12 has been connected to the container 14.

Figure 2:
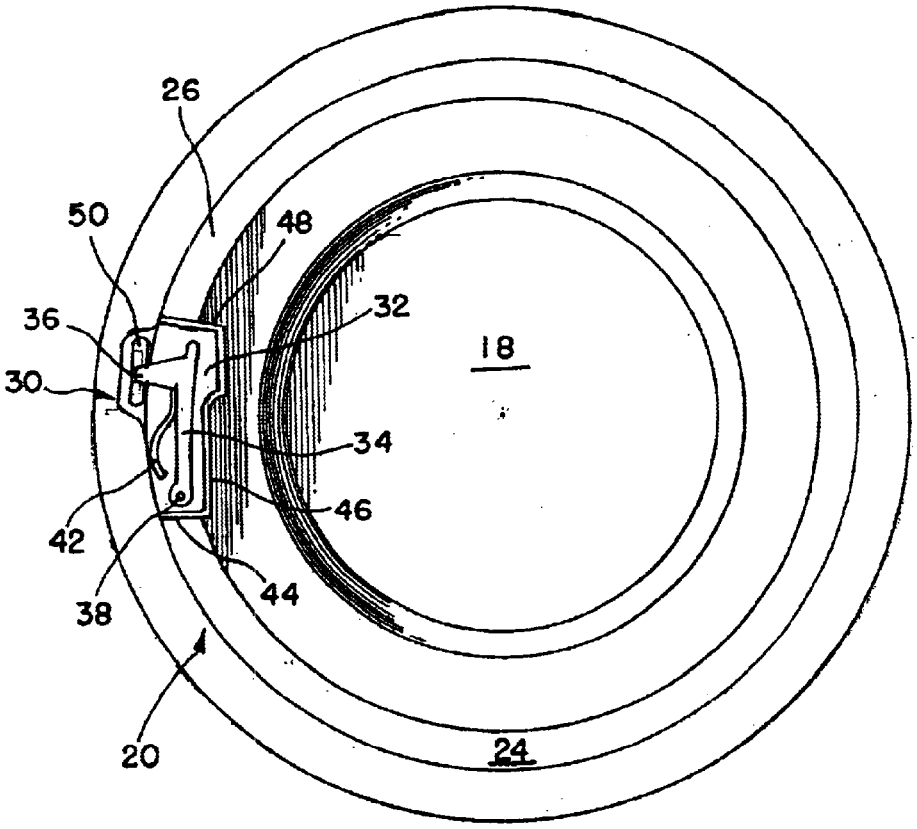
FIG. 2 is a top plan view of the lid shown in FIG. 1.
Figure 3:
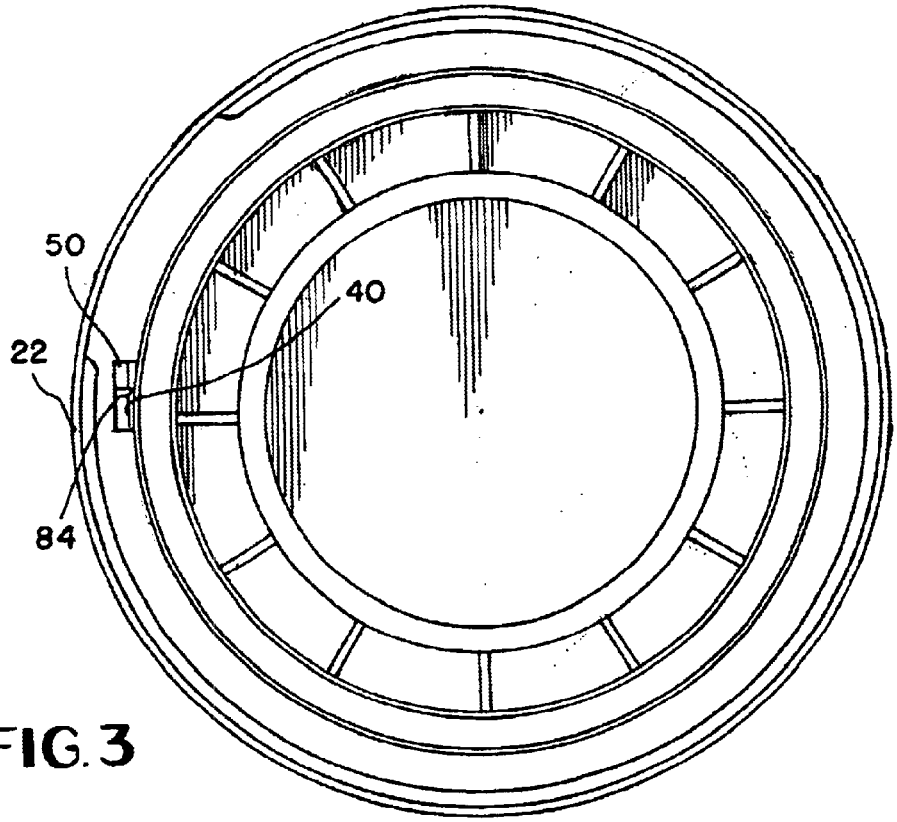
FIG. 3 is a bottom plan view of the lid shown in FIG. 2.
Figure 4:
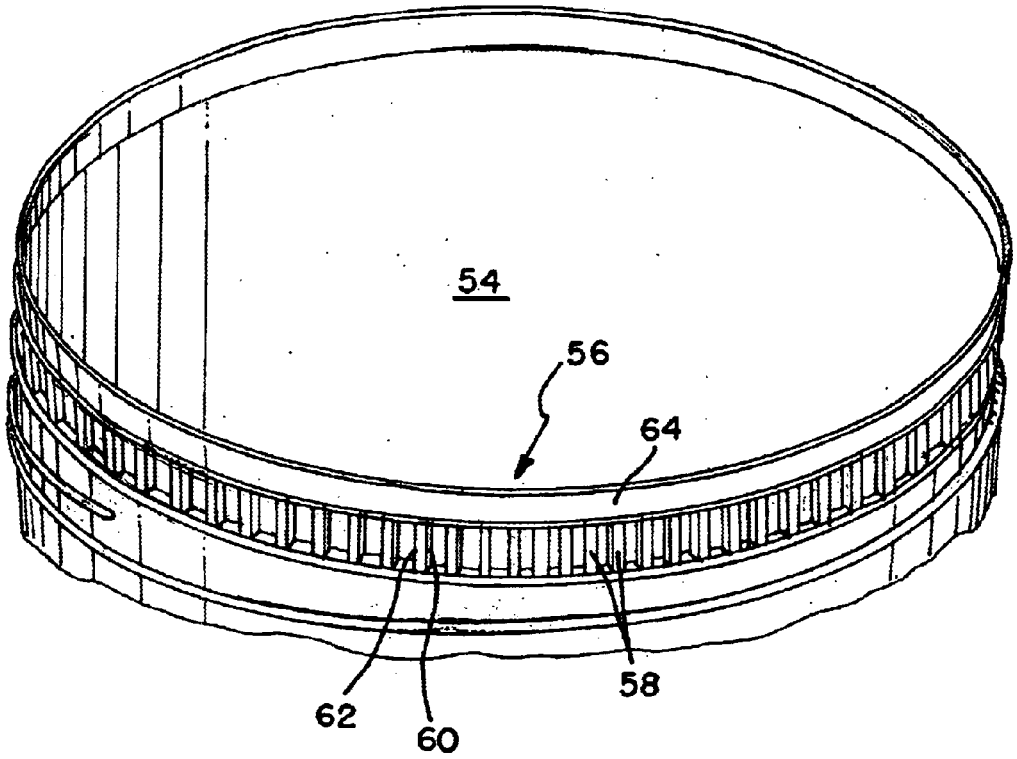
FIG. 4 is perspective view of a top portion of the container of FIG. 1.
Figure 5:
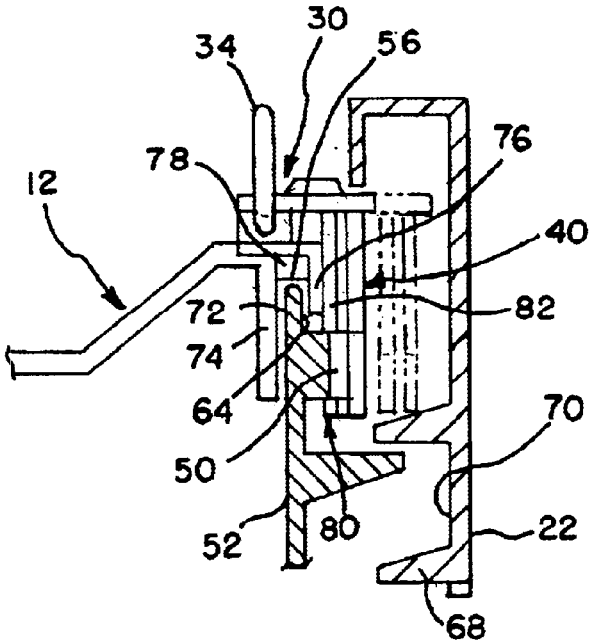
FIG. 5 is an exploded cross sectional view of the lid apart from the container showing the placement of the container relative to the lid when threadably engaged thereto with the locking mechanism.

Details of the lid 12 may be better seen in FIGS. 2 and 3, while FIG. 4 shows details of the container 14. Finally FIG. 5 shows the connection of the lid 12 with the container 14 which is at least partially obscured from view in FIG. 1.

The lid 12 has a center portion 18 preferably surrounded by a ridge 20. The ridge 20 is defined and/or bounded by a downwardly extending outer wall 22. If the ridge 20 is not utilized, the downwardly extending outer wall 22 surrounds the center portion 18. The ridge 20 illustrated is formed from the downwardly extending outer wall 22, a top portion 24, and an inner wall 26. A shelf 28 is illustrated extending from the inner wall 26. The locking member 30 of the locking mechanism 16 is shown at least partially supported by the shelf 28. The shelf 28 preferably is planar to one or both of the center portion 18 and the top portion 24 of the ridge 20. The shelf 28 is also illustrated a distance from the center portion 18.

FIG. 2 shows a ledge 32 extending from the shelf 28 to provide a little more room for operating the locking member 30. The locking member 30 is comprised of a finger 34 which is pivotable about pivot 38. The finger 34 is connected to an arm 36 which connects to a downwardly extending leg 40 which is shown in FIGS. 3 and 5.

Spring member 42 biases the finger, and thus the arm 36 and leg 40 into a locking position shown in the figures. Application of force to the finger 34 sufficient to overcome the bias of the spring member 42 moves the finger 34 about the pivot 38. The leg 40 is then moved away from the center portion 18 of the lid 12. Furthermore, as shown in FIG. 5, as the leg 40 moves away from the center portion 18 of the lid 12, the leg 40 also moves out of engagement with one or more of the teeth as will be explained in more detail below.

As shown in FIG. 1, protecting walls 44,46,48 provide protection to the locking member 30, especially when stacking multiple container assemblies 10 on top of one another. A portion of protecting walls 46,48 is shaped to allow for easy operation of the finger by providing access to the finger 34.

The lid 12 includes a cutout 50 which allows the leg 40 and/or arm 36 of the locking member 30 to pass through from the top side of the lid shown in FIG. 2 to the bottom side shown in FIG. 3. The cutout 50 is positioned relative to the open ended container 14 when connected together such that the cutout is radially outward of the interior wall surface 52 of the container 14. This may be better illustrated after explaining the construction of the container 14 as shown in FIG. 4 and visualizing the operation of the locking mechanism as illustrated in an exploded view in FIG. 5.

The container has an interior wall surface 52 which defines a cavity 54 therein. The cavity 54 is where material, such as liquid, is stored in the container 14. The inner wall surface 52 is preferably substantially smooth and continuous extending in a cylindrical manner to the top 56 of the open ended container 14. On the exterior of the container 14 are outwardly facing teeth 58. Each of outwardly facing teeth 58 preferably have a ramped surface 60 and a substantially radially extending surface 62 as shown in FIG. 4. The teeth are illustrated as spaced by rim 64 from the top 56 of the container 14.

Below the teeth 58 are one or more outwardly facing threads 66. The outwardly directed threads 66 of the container 14 cooperate with inwardly directed threads 68 on the inner surface 70 of the outer wall 22 of the lid 12. As the lid 12 is rotated relative to the container 14, the threads 66,68 allow for the lid 12 to be connected and disconnected from the container 14.

As the lid 12 is being secured to the container 14 by rotating the threads 66,68 relative to one another, the rim 64 preferably locates within slot 72 in the bottom of the lid 12. The slot 72 is defined by interior projection 74 and exterior projection 76. A sealing ring 78 may be located within the slot 78 in some embodiments, or the fit of the rim 64 within the slot 72 may be sufficient to create a watertight seal when the lid 12 is completely closed relative to the container 14.

As the lid 12 is being tightened relative to the container 14, the leg 40, a blade 80 on the leg 40 contacts the teeth 58. It is preferred that the blade 80 has a ramped surface 82 so that the ramped surface 82 of the blade 80 and the ramped surface 60 of the teeth 58 act against one another to force the leg 40 away from the center portion 18 of the lid 12 to allow the lid 12 to be tightened.

However, when one attempts to "unscrew" the lid 12 from the container, the back surface 84 of the leg 40 contacts the radially extending surface 62 of at least one of the teeth 58 and prevents rotation in the "off" direction. In order to remove the lid 12 from the container 14, the leg 40 must be moved, such as by pushing on the finger 34 which moves the leg 40 with the blade 80 outwardly away from the center portion 18 of the lid 12 and out of contact with the teeth 58. This allows for the outward rotation of the lid 12 relative to the container 14. Without moving the leg 40 out of the way, the back surface 84 and radially extending surface 62 contacting one another make removal of the lid 12 very difficult, if not almost impossible, since these contacting surfaces will prevent rotation in the "outward" direction.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A container assembly comprising an open ended container having outwardly directed threads on an outer exterior wall surface of the container and a plurality of outwardly directed teeth intermediate the threads and a top of the container on the outer exterior wall surface; and a lid having a downwardly extending outer wall having inwardly directed threads, a cutout in the lid, and a locking member extending through the cutout, said inwardly directed threads of said lid configured to cooperate with the outwardly directed threads of said container to secure the lid relative to the container, said locking member normally biased radially inwardly towards a center of the lid in a first position to engage at least one of the outwardly directed teeth of the container in a locked configuration and moveable radially outwardly to a second position to allow rotation of the lid relative to the container in at least one direction.

2. The container of claim 1 wherein rotating of said lid relative to said container in said at least one direction, loosens and subsequently disconnects the lid from the container.

3. The container of claim 1 wherein the threads of the lid and container are engaged, the locking member contacts at least one of the outwardly directed teeth in the first position.

4. The container of claim 3 wherein movement of the locking member to the second position disengages the locking mechanism from the at least one of the outwardly directed teeth to allow for rotation of the lid relative to the container in at least one direction.

5. The container of claim 1 wherein the locking member further comprises a finger rotatably mounted about a pivot, an arm connected to the finger, and a leg connected to the arm, wherein at least one of said leg and arm extend through the cutout.

6. The container of claim 4 wherein the leg has a blade connected thereto, and said blade contacts at least one of the teeth in the first position to prevent rotation the at least one direction, and movement of the finger moves the blade from contact with the at least one of the teeth to allow rotation in the at least one direction in the second position.

7. The container of claim 6 wherein the blade has a ramped surface and each of the plurality of teeth have a ramped surface and a radially extending surface, and rotation of the lid with the locking member in the first position in a first direction results in the ramped surfaces of the teeth and blade cooperating with one another to allow rotation in the first direction, and attempts at rotating in the second direction which is opposite to the first direction result in a back surface of the blade contacting the radially extending surface of the at least one teeth to prevent rotation in the second direction.

8. The container of claim 1 wherein the container further comprises an interior wall surface defining a cavity therein and the cutout in the lid is outwardly spaced from the interior wall surface when the lid is connected to the container.

9. The container of claim 1 wherein the lid further comprises a ridge and the cutout is at least partially in the ridge.

10. The container of claim 9 wherein the ridge is defined by an interior wall, a top portion, and the outer wall of the lid.

11. The container of claim 1 wherein the container further comprises a rim above the plurality of teeth, and the lid further comprises a slot on a bottom surface of the lid, said slot configured to receive the rim when connecting the lid to the container.

12. A container assembly comprising an open ended container having a container wall with an interior surface defining a cavity therein, and an outer exterior surface with outwardly directed threads thereon and at least one radially outwardly extending latch member on the exterior surface; and a lid having a downwardly extending outer wall with inwardly directed threads, a cutout in the lid, and a locking member extending through the cutout, said inwardly directed threads of said lid configured to cooperate with the outwardly directed threads of said container to secure the lid relative to the container, said locking member normally biased radially inwardly towards the latch member thereby engaging at least one of the at least one latch members in a first position and moveable radially outwardly to a second position to allow rotation of the lid relative to the container in at least one direction.

13. The container assembly of claim 12 wherein the container has a rim at a top of the wall, and the lid has a slot on a bottom portion which receives the rim in a closed configuration, said rim located above the at least one latch member.

14. The container of claim 12 wherein the at least one latch member is located intermediate the outwardly directed threads and the top of the container.

15. The container of claim 12 wherein the locking member has a finger rotatable about a pivot, an arm connected to the finger, and a leg extending from the arm.

16. The container of claim 15 wherein the finger is biased in the first position by a spring member, and at least one of the arm and leg extend through the cutout where the leg is positioned to engage the at least one latch member in the first position.

17. The container of claim 12 wherein the at least one latch member further comprises a plurality of outwardly directed teeth, and the plurality of outwardly directed teeth each have a ramped surface and a radially outwardly directed surface.

18. The container of claim 17 wherein when the lid is connected to the container, the locking member cooperates with the teeth to selectively lock the lid in the first position.

19. The container of claim 18 wherein the locking member further comprises a leg with a blade having a ramped surface, said ramped surface of said blade cooperating with said ramped surface of said plurality of teeth to allow rotation in a first direction when the locking member is in the first position, and said leg contacting at least one of the radially extending surfaces of the plurality of teeth when attempting to rotate said lid in a second direction opposite the first direction to prevent further rotation in the second direction with the locking member in the first position.

20. The container assembly of claim 19 wherein movement of the locking member to the second position disengages the blade from the at least one radially extending surface to allow rotation in the second direction.

* * * * *